United States Patent [19]

Imai et al.

[11] Patent Number: 4,902,150

[45] Date of Patent: Feb. 20, 1990

[54] PRINTING APPARATUS WITH AN ELONGATED SIGNAL-TRANSMITTING FLEXIBLE MEMBER

[75] Inventors: Tatsuji Imai, Ichinomiya; Masaya Funamoto, Higashi, both of Japan

[73] Assignee: Brother Kogyo Kabushiki Kaisha, Nagoya, Japan

[21] Appl. No.: 338,430

[22] Filed: Apr. 14, 1989

Related U.S. Application Data

[63] Continuation of Ser. No. 140,774, Jan. 4, 1988, abandoned.

[30] Foreign Application Priority Data

Jan. 6, 1987 [JP] Japan ..... 62-462[U]

[51] Int. Cl.[4] ..... B41J 25/30

[52] U.S. Cl. ..... 400/320; 174/69; 174/86; 439/13; 439/446; 400/719

[58] Field of Search ..... 400/322, 320, 323, 719; 439/446, 448, 470, 6, 11, 13; 174/86, 69

[56] References Cited

U.S. PATENT DOCUMENTS

| | | | |
|---|---|---|---|
| 1,168,350 | 1/1916 | Wakefield | 174/86 X |
| 1,187,010 | 6/1916 | Rodrigues | 439/446 |
| 1,549,291 | 8/1925 | Broman | 174/86 X |
| 2,339,683 | 1/1944 | Cox | 174/69 X |
| 2,450,369 | 9/1948 | Bellis | 439/448 |
| 3,138,655 | 6/1964 | Navarro et al. | 174/69 |
| 3,551,612 | 12/1970 | Guentner | 174/69 X |
| 4,208,142 | 6/1980 | Chu | 400/320 |
| 4,425,047 | 1/1984 | Narushima | 400/320 X |
| 4,586,838 | 5/1986 | Hara et al. | 400/320 |

FOREIGN PATENT DOCUMENTS

| | | | |
|---|---|---|---|
| 1345760 | 11/1963 | France | 174/69 |
| 74168 | 5/1982 | Japan | 400/320 |
| 858869 | 1/1961 | United Kingdom | 174/69 |
| 2010187A | 6/1979 | United Kingdom . | |

*Primary Examiner*—Clifford D. Crowder

*Attorney, Agent, or Firm*—Jones, Tullar & Cooper

[57] ABSTRACT

A printing apparatus comprises a movable carriage mounted with a printing mechanism that reciprocates along a printing line on a platen, and a control unit, which is provided on a printer body in a stationary manner and sends control signals to the printing mechanism for its various operations. A flexible member connected to the carriage and the control unit for transmission of the control signals. For this purpose, the flexible member is connected at one end to the printing mechanism. The flexible member has a first end portion at a proximity of that end, which is clamped by a connecting member pivotally supported on the carriage. This connecting member can swing to permit free deformation of the flexible member which is caused by the movement of the carriage.

5 Claims, 3 Drawing Sheets

PRINTING APPARATUS WITH AN ELONGATED SIGNAL-TRANSMITTING FLEXIBLE MEMBER

This is a continuation of co-pending application Ser. No. 07/140,774 filed on Jan. 4, 1988, abandoned.

BACKGROUND OF THE INVENTION

The present invention relates to a printing apparatus such as a printer, a typewriter or a computer terminal, which is provided with a carriage that has a printing mechanism facing a platen and operable to perform a printing operation and is reciprocally movable along a printing line on the platen, a control unit provided on a printer body for sending a control signal to the printing mechanism of the carriage for a printing operation, and an elongated signal-transmitting flexible member for electrically connecting the carriage and the control unit.

In conventional printing apparatuses of this type, a plurality of wires, connected to a character selection motor, a solenoid for a printing hammer, etc. which are mounted to the carriage, are fitted in a bundle in a flexible protective tube to be a cable serving as the elongated signal transmitting flexible member, and this cable extends on a movable path of the carriage and is connected at its one end to a control circuit board constituting the control unit. In this case, both end portions with some length of the protective tube for the cable are firmly fixed respectively to one outer side face of the carriage and the bottom of a case for the printing apparatus, through clamps by means of attaching means such as screws.

The reason for employing the above connection structure where the cable is fixed at one end portion with some length to the carriage and at the other end portion also with some length to the control unit, is to prevent the cable from being disconnected or damaged at the connecting sections, which disconnection or damage is very likely to occur when these end portions of the cable are excessively bent or pulled.

However, according to the conventional printing apparatuses, particularly, that end portion of the protective tube which is fixed to the carriage always faces in a fixed direction, so that when the carriage moves within its movable range, the cable is bent with a very small bending radius particularly as the carriage reaches either end position of the movable range. This bending action applies an excessive bending stress to the wires of the cable and the protective tube, thus deteriorating their wearability. And the bending resistances of the wires and the protective tube increase the moving load of the carriage.

As such a cable, there is a thin flat, flexible belt type having a number of wires, but this belt is expensive so as to increase the manufacturing cost of the printing apparatuses and junction board and a connector needs to be provided under the movable region of the carriage.

SUMMARY OF THE INVENTION

With the above circumstances in mind, therefore, it is an object of this invention to provide a printing apparatus with such a connecting structure of a flexible cable that can improve the wearability of an elongated signal-transmitting flexible member of the flexible cable and reduce the moving load of a carriage.

To achieve the above object, a printing apparatus of this invention basically comprises an elongated signal-transmitting flexible member, which is connected at one end to a printing mechanism provided on a carriage and at the other end to a stationary control unit mounted on a printer body so as to transmit a control signal to the printing mechanism from the control unit, and a connecting member, which is engaged with a first end portion at a proximity of the one end of the flexible member and is connected to the carriage in such a manner that the first end portion is swingable with respect to the carriage.

With the above structure, the connecting member can freely swing with respect to the carriage through the first end portion of the flexible member that bends and deforms in accordance with the moving position of the carriage, so that an excessive bending stress applied on the flexible member by the carriage can be reduced. As compared with the prior art, therefore, the bending radius of the flexible member can be kept greater and the wearability of the flexible member can be improved. In addition, the reactive force on the carriage from the flexible member is reduced, thus reducing the resistance against the movement of the carriage, namely, the moving load of the carriage. This contributes to making a carriage driving motor compact and making the printing apparatus compact accordingly.

According to a preferred embodiment of this invention, the connecting member is pivotally supported on the carriage at one pivoting point and the first end portion of the flexible member is clamped on the opposite side of the one end of the flexible member with respect to the pivoting point.

With the above structure, the flexible member can be given more freedom to deform in accordance with the movement of the carriage without causing such a significant movement of the one end of the flexible member that disconnection would occur at the connecting section.

According to another preferred arrangement, a second end portion at a proximity of the other end of the flexible member, is connected to the control unit, is guided and held by guide means. Therefore, when an undesirable stress such as tension is applied to the other end at the time the flexible member is bent, the second end portion is held by the guide means so as to inhibit external force from acting on the other end, thus protecting an electrical connection at the other end against such stress.

Other objects and other various advantages of this invention will be readily apparent as the description of preferred embodiments of this invention proceeds with reference to the accompanying drawings.

DESCRIPTION OF THE PREFERRED EMBODIMENT

One embodiment of this invention will now be explained in detail referring to FIGS. 1 through 4.

Figure 1:
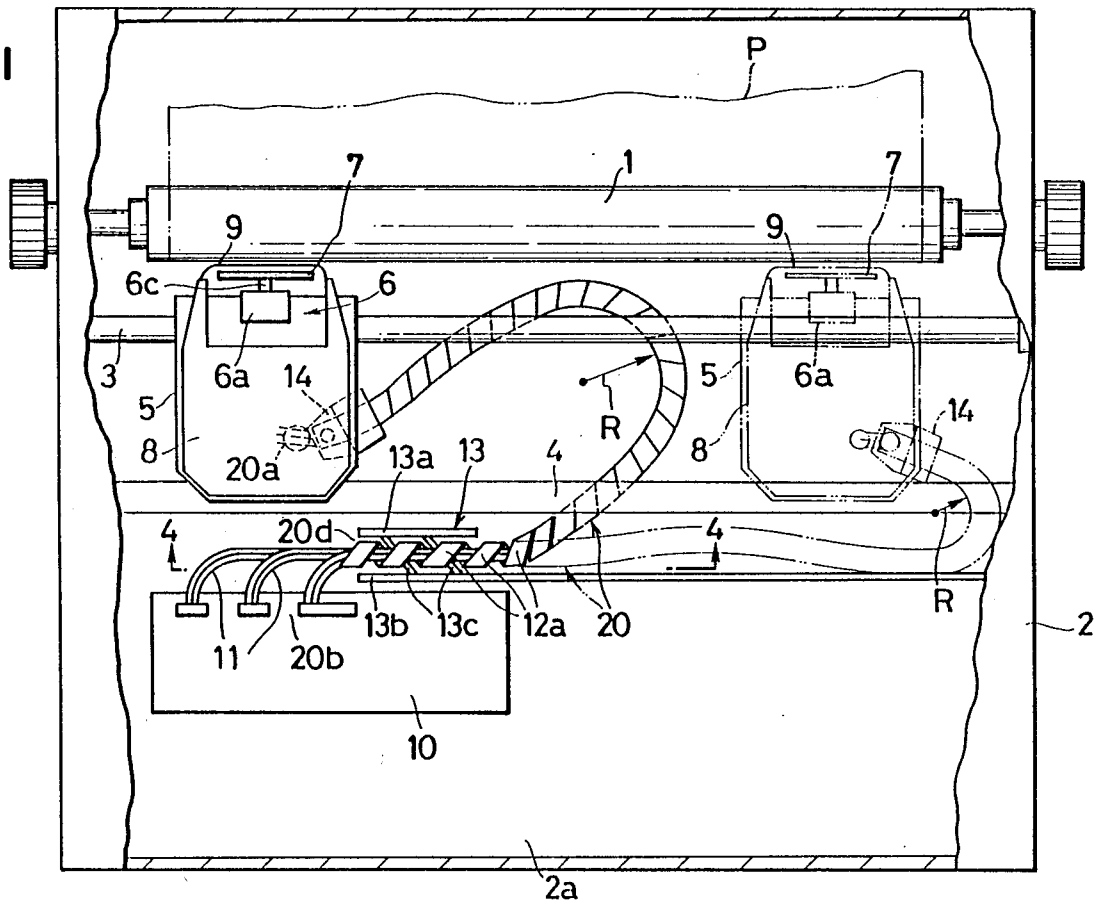
FIG. 1 is a partially cutaway plan view of a printing apparatus according to one embodiment of the present invention.

In a printing apparatus according to this embodiment, as shown in FIG. 1, a platen 1 is rotatably mounted to a case 2 as a printer body of the printing apparatus, and a guide shaft 3 and a guide rail 4 are disposed in parallel along the platen 1. A carriage 5 is mounted on the guide shaft 3 and the guide rail 4 movable along a printing line on the platen 1 and is moved reciprocally by a carriage driving motor (not shown) along the platen 1 within its movable range corresponding to approximately the entire length of the platen 1.

A character selection motor 6*a*, a solenoid (not shown) for energizing a printing hammer and a type wheel 7, which constitute a printing mechanism 6, are mounted on the carriage 5. The wheel 7 is supported through an output shaft 6*c* to the character selection motor 6*a* and has a plurality of character elements (not shown) on its periphery. Further, a ribbon cassette 8 is detachably supported on the carriage 5, and a printing ribbon 9 accommodated in the cassette 8 is partially exposed between the type wheel 7 and the platen 1. In executing a printing operation, one of the character elements of the type wheel 7 which is selected by the character selection motor 6*a* is struck by the printing hammer and is consequently pressed against a printing sheet P (indicated by a two-dot chain line) set on the platen 1, through the printing ribbon 9.

In order to output electric control signals to the printing mechanism 6 on the carriage 5 for driving the printing mechanism 6, a circuit board 10 constituting a control unit is provided in a stationary manner on a bottom cover 2*a* of the case 2 of the printer body.

A flexible cable 20, which constitutes an elongated signal-transmitting flexible member for electrically connecting the stationary circuit board 10 and the printing mechanism 6 on the movable carriage 5, is connected at its one end 20*a* to the printing mechanism 6 on the carriage 5 and at the other end 20*b* to the circuit board 10. The control signals are transmitted through this cable 20 to the printing mechanism 6 from the circuit board 10. As shown in FIG. 1, the cable 20 is designed such that when the carriage 5 reciprocates between the left end position indicated by the solid line and the right end position in its movable range, the cable 20 can leisurely follow the movement of the carriage, flexibly bending or deforming.

The flexible cable 20 comprises a number of bundled wires 11 and a protective tube 12, which is wound around the outer periphery of the wire bundle in a spiral manner and is made of synthetic resin such as soft polyethylene.

Figure 2:
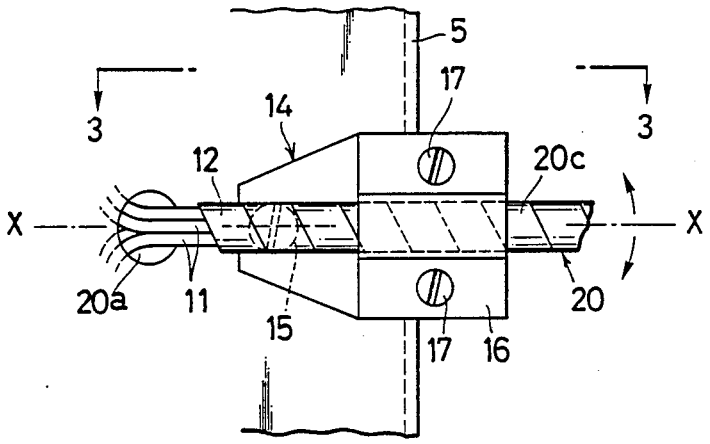
FIG. 2 is an enlarged view of a connecting section between a carriage and a flexible cable, as shown in FIG. 1, as viewed from the back side of the carriage.
Figure 3:
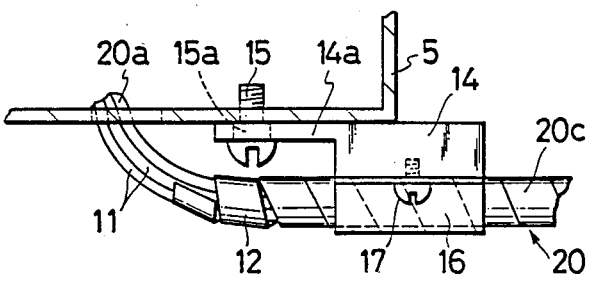
FIG. 3 is a side view of the connecting section as viewed along line 3—3 of FIG. 2.

As shown in FIGS. 1 to 3, a connecting member 14 having a step section 14*a* is rotatably supported on the bottom of the carriage 5 by means of a stepped screw 15 with respect to the carriage 5, and an end portion 20*c* located at a proximity of the one end 20*a* of the flexible cable 20 is tightened through a clamp 16 on the connecting member 14 by means of a screw 17.

With the above arrangement, the end portion 20*c* of the flexible cable 20 is restricted by the connecting member 14 not to be moved by an external force acting on the cable 20 in an axial direction X—X. This therefore prevents the electric connection of the cable 20 at the one end 20*a* from being adversely affected by the external force acting in the axial direction X—X.

The connecting member 14 can pivot, with the end portion 20*c* of the cable 20 being held, around the screw 15 serving as a pivoting point, as shown by the arrows in FIG. 2. The pivoting point 15 is designed so as to be closer to the one end 20*a* of the cable 20 with respect to the clamping position of the end portion 20*c* of the cable 20. Therefore, even with the pivoting motion of the connecting member 14, the one end 20*a* of the cable 20 does not swing so much.

Figure 4:
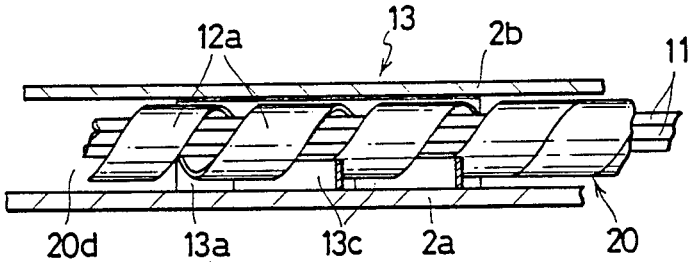
FIG. 4 is an enlarged view of a connecting section between the flexible cable and a printer body, as shown in FIG. 1, along line 4—4 thereof.

As shown in FIGS. 1 and 4, a guide section for guiding and holding another end portion 20*d* located at a proximity of the other end 20*b* of the cable 20 is protrusively provided on the bottom cover 2*a* at a proximity of the circuit board 10. This guide section has a pair of side walls 13*a*, 13*b* and a pair of inclined walls 13*c*, which serve as stopper walls and obliquely connect the side walls 13*a* and 13*b*. Of the side wall pair, the side wall 13*a* on the carriage side is formed short so as not to interrupt the movement of the cable 20 in accordance with the movement of the carriage 5, while the other side wall 13*b* on the circuit board side extends to a proximity of the right end of the carriage movable range. The end portion 20*d* of the cable 20 is guided and fitted between the side walls 13*a* and 13*b*, and spiral turn portions 12*a* of the tube 12 of the cable 20 are held engaged with the inclined walls 13*c* with part of the tube 12 being pulled. This restricts the forward and backward movements and right and left movements of the end portion 20*d* of the cable 20. Further, as shown in FIG. 4, part of a board cover 2*b* for covering the circuit board 10 is disposed above the guide section 13 in parallel to and facing the bottom cover 2*a*, so that the vertical movement of the end portion 20*d* of the cable 20 can also be restricted. That is, a channel with a rectangular cross section is formed in the guide section 13 by the two side walls 13*a*, 13*b* and the covers 2*a*, 2*b*, and the end portion 20*d* of the cable 20 is guided and fitted in the channel. The side wall pair 13*a* and 13*b* guides the end portion 20*d* of the cable 20 in parallel to the moving direction of the carriage 5.

When the carriage 5 is reciprocated within its movable range for the printing mechanism 6 to execute the printing operation and reaches the left moving end as indicated by the solid line in FIG. 1, the connecting member 14 on the carriage 5 comes close to the guide section 13. Consequently, the whole cable 20 is significantly bent in a nearly horizontal plane between the connecting member 14 and the guide section 13, and the connecting member 14 swings toward the platen 1 with the bending of the cable 20. On the other hand, when the carriage 5 reaches the right moving end as indicated by the two-dot chain line and the connecting member 14 is moved away from the guide section 13 as shown in FIG. 1, the cable 20 is guided along the side wall 13*b*. When tension is applied to the cable 20, the turn portions 12*a* engaged with the inclined walls 13*c* in the guide section 13 are more firmly engaged with these walls 13*c*. Further, the end portion of the cable 20 located on the carriage side is bent and the connecting member 14 swings toward the opposite side to the platen 1 with the bending of the cable 20. And, during the movement of the carriage 5, the amount and direction of the swing motion of the connecting member 14 continuously vary with a change in the moving position of the carriage 5. Therefore, no excess tension applies on the one end portion 20*a* and the other end portion 20*b* of the cable 20.

With the above structure of this invention, the bending radius of the tube 12 and the wires 11 disposed in the tube, i.e., the bending radius R of the cable 20, is greater than the one involved in the prior art. This prevents an excess bending stress from being applied to the cable 20 and improves the wearability of the cable 20.

When the number of the wires 11 to be accommodated in the tube 12 is too large to provide a great freedom with respect to the diameter of the tube 12, the wires 11 are likely to rub one another in the tube 12 so that some of the wires 11 may be pulled inside or outside the carriage 5. In this respect, therefore, it is desirable that the wires 11 in the tube 12 be bundled themselves at a proximity of the clamp 16 and be fixed to the clamp 16.

Since the bending radius R can be prevented from being significantly small, the force on the carriage 5 which is generated by the deformation of the cable 20, i.e., the moving load of the carriage can be reduced. This contributes to making the carriage driving motor (not shown) compact and reducing the dissipation power of this motor, and naturally contributes to making the overall printing apparatus compact.

Further, if the core of each wire 11 is formed by twisting a number of narrow strands, the wearability and the flexibility of the wires 11 with respect to the curvature can be increased, thus ensuring a further compactness of the printing apparatus.

According to this embodiment, as explained above, the lateral movement of the end portion 20*d* of the cable 20 on the side of the circuit board 10 is restricted by the guide section 13 provided on the bottom cover 2*a* and the tension acting on the cable 20 is suppressed by the inclined walls 13*c* so that the cable 20 hardly moves in its axial direction. As compared with the prior art, therefore, no excess external force acts on the cable end 20*b* connected to the circuit board 10. This can eliminate the need for the clamp and screws on the side of the circuit board 10, and thus reduce the number of the necessary parts, resulting in reduction of the manufacturing cost of the printing apparatus.

The turn portions 12*a* of the tube 12 may each have a narrower width in order to facilitate the bending of the cable 20, i.e., to provide a smaller bending radius R. According to the embodiment, the width of each turn portion is set to about 10 mm; this width may be made narrower. In addition, according to the embodiment, the turn portions 12*a* of the tube 12 are wound around the wires 11 so close to one another as to hardly have any interval between the adjacent turn portions in a normal state. However, the adjacent turn portions 12*a* may be slightly separated from each other even in the normal state, thereby facilitating the bending of the cable 20.

The above embodiment may be modified in various ways. As some possible modifications, the connecting member 14 can be provided on the side portion of the carriage 5, or the connecting member 14 and the clamp 16 can be formed as an integral member, or instead of using the protective tube 12, the wires 11 may be held directly by the connecting member 14.

Figure 5:
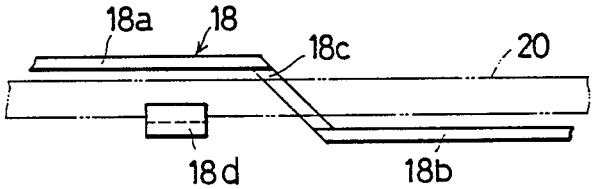
FIGS. 5 and 6 are schematic diagrams illustrating modifications of the connecting structure shown in FIG. 4.
Figure 6:
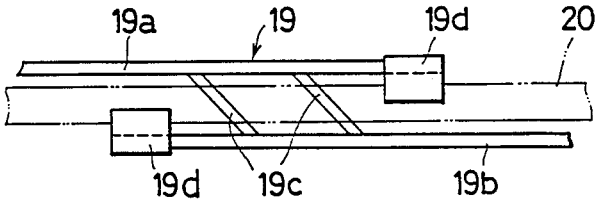

FIGS. 5 and 6 illustrate modified structures of the guide section 13 shown in FIG. 4.

As shown in FIG. 5, a guide section 18 for guiding and holding the end portion of the cable 20, which is located on the side of the circuit board 10, can be designed to have a pair of parallel side walls 18*a*, 18*b* and an inclined wall 18*c* for connecting these side walls 18*a*, 18*b* at their close ends and an L-shaped hook 18*d* for restricting the vertical movement of the tube 12 can be provided at a position facing the side wall 18*a*, one of the side wall pair. Like the side walls 18*a*, 18*b* and the inclined wall 18*c*, this hook 18*d* is provided, though not illustrated here, on the bottom cover 2*a* as shown in FIG. 1. With this arrangement, therefore, the lateral and vertical movements of the cable 20 can be restricted respectively by the side walls 18*a*, 18*b* and by the bottom cover 2*a* and the hook 18*d*. The inclined wall 18*c* functions in the same manner as the inclined walls 13*c* of the above-described embodiment.

As shown in FIG. 6, a guide section 19 for guiding and holding the end portion of the cable 20, which is located on the side of the circuit board 10, can be designed to have a pair of parallel side walls 19*a*, 19*b* that partially face each other, and two inclined walls 19*c* for connecting these side walls 19*a* and 19*b*, and a hook 19*d* for restricting the vertical movement of the cable 20 can be provided at one end portion of each of the side walls 19*a* and 19*b*. Each hook 19*d* has the same shape as the hook 18*d* shown in FIG. 5. The pair of inclined walls 19*c* function the same way as the inclined walls 13*c* of the above-described embodiment and the inclined wall 18*c* of the modification shown in FIG. 5.

Needless to say, the present invention is not limited to the above embodiment or the above modifications, but can be modified in various manners within the scope and spirit of this invention.

What is claimed is:

1. A printing apparatus comprising:

a printer body;

a platen, supported on said printer body, for supporting a printing medium;

a carriage supported on said printer body so as to be reciprocally moved along a printing line on said platen and having a printing mechanism facing said platen and operable to print on said printing medium in cooperation with said platen;

a stationary control unit, disposed on said printer body, for sending a control signal for operating said printing mechanism;

an elongated signal-transmitting flexible member coupled at one end to said printing mechanism of said carriage and at the other end to said control unit on said printer body for transmitting said control signal from said control unit to said printing mechanism, comprising a plurality of bundled wires and a protective tube for covering said wires over substantial by the whole length of the flexible member, said protective tube being constituted by a plurality of turn portions wound around said bundled wires in spiral form;

said flexible member having a first end portion at a proximity of said other end thereof and a second end portion at a proximity of said other end thereof;

a connecting member for pivotally holding said first end portion on said carriage, said connecting member having a clamp section which clamps the first end portion and is pivotable around one pivoting point positioned closer to said one end of the flexible member than said clamp section; and guide means provided in said printing body, having a pair of side walls located on both sides of said second end portion of the flexible member along a lengthwise direction thereof, thereby restricting free movement of the second end portion of the flexible member along a transverse direction of the flexible member, and having a stopper wall which is located between said side walls and is inclined with a predetermined angle with respect to said side walls so as to loosely engage some of said turn portions of the protective tube, thereby restricting free movement of the second end portion of the flexible member along a lengthwise direction of the flexible member.

2. The printing apparatus according to claim 1, wherein said clamp section of said connecting member is pressed against an outer surface of said protective tube.

3. The printing apparatus according to claim 1, wherein one of said pair of side walls extends substantially entirely over a movable range of said carriage.

4. The printing apparatus according to claim 1, wherein said guide means further has a movement restricting member for restricting a vertical movement of said second end portion of said flexible member.

5. The printing apparatus according to claim 4, wherein said movement restricting member is at least one L-shaped hook member disposed on said printer body in such a manner as to face one of said pair of side walls.

* * * * *